US011952779B2

(12) United States Patent
Budinscak, Jr. et al.

(10) Patent No.: US 11,952,779 B2
(45) Date of Patent: Apr. 9, 2024

(54) INSULATION BOARDS WITH INTERLOCKING SHIPLAP EDGES

(71) Applicant: Owens Corning Intellectual Capital, LLC, Toledo, OH (US)

(72) Inventors: John F. Budinscak, Jr., Wadsworth, OH (US); Jason E. Bollinger, Sylvania, OH (US); Nigel W. Ravenscroft, Hudson, OH (US); David Caputo, Sylvania, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 0 days.

(21) Appl. No.: 18/052,612

(22) Filed: Nov. 4, 2022

(65) Prior Publication Data

US 2023/0235555 A1 Jul. 27, 2023

Related U.S. Application Data

(63) Continuation of application No. 17/215,049, filed on Mar. 29, 2021, now abandoned.

(60) Provisional application No. 63/020,463, filed on May 5, 2020.

(51) Int. Cl.

| | |
|---|---|
| ***E04C 2/20*** | (2006.01) |
| ***E04B 1/80*** | (2006.01) |
| *E04C 2/00* | (2006.01) |

(52) U.S. Cl.

CPC ..... *E04C 2/205* (2013.01); *E04B 1/80* (2013.01); *E04C 2002/004* (2013.01)

(58) Field of Classification Search

CPC ..... E04C 2/205; E04C 2002/004; E04B 1/80; E04B 1/6179; E01C 2201/12; E01C 3/006; E01C 3/06

USPC ..... 52/591.4

See application file for complete search history.

(56) References Cited

U.S. PATENT DOCUMENTS

| | | | | |
|---|---|---|---|---|
| 2,110,728 A | | 3/1938 | Hoggatt | |
| 2,241,642 A | * | 5/1941 | McCauley | E04F 13/0864 52/539 |
| 2,398,632 A | | 4/1946 | Frost et al. | |
| 3,093,935 A | | 6/1963 | Dunn | |
| 3,205,633 A | * | 9/1965 | Nusbaum | E04F 15/10 52/591.1 |
| 3,290,848 A | * | 12/1966 | Moss | E04B 9/0478 52/591.4 |
| 3,468,086 A | | 9/1969 | Warner | |
| 3,613,327 A | | 10/1971 | Hall | |
| 3,678,643 A | | 7/1972 | Schwarz | |

(Continued)

FOREIGN PATENT DOCUMENTS

| | | |
|---|---|---|
| CA | 2377702 A1 | 11/2002 |
| CA | 2458918 A1 | 11/2002 |

(Continued)

OTHER PUBLICATIONS

International Search Report and Written Opinion from PCT/US21/24553 dated Aug. 12, 2021.

(Continued)

*Primary Examiner* — Brent W Herring

(74) *Attorney, Agent, or Firm* — Calfee, Halter & Griswold LLP

(57) ABSTRACT

Foam insulation boards having an improved shiplap edge for interfacing with one another are disclosed.

16 Claims, 12 Drawing Sheets

(56) References Cited

U.S. PATENT DOCUMENTS

| | | | | |
|---|---|---|---|---|
| 3,832,263 | A | 8/1974 | Cleveland et al. | |
| 3,984,270 | A | 10/1976 | Haage | |
| 4,288,951 | A | 9/1981 | Carlson et al. | |
| 4,320,605 | A | 3/1982 | Carlson et al. | |
| 4,522,004 | A | 6/1985 | Evans et al. | |
| 4,615,162 | A | 10/1986 | Evans | |
| 4,769,963 | A | 9/1988 | Meyerson | |
| 4,998,396 | A | 3/1991 | Palmersten | |
| 5,056,281 | A | 10/1991 | McCarthy | |
| 5,343,665 | A | 9/1994 | Palmersten | |
| 5,373,678 | A | 12/1994 | Hesser | |
| 5,664,386 | A | 9/1997 | Palmersten | |
| 5,671,575 | A | 9/1997 | Wu | |
| D406,360 | S | 3/1999 | Finkell, Jr. | |
| 6,460,583 | B1 * | 10/2002 | Lindal | B27M 3/0046 52/748.1 |
| 6,546,691 | B2 | 4/2003 | Leopolder | |
| 6,558,765 | B2 | 5/2003 | Padmanabhan | |
| D486,592 | S | 2/2004 | Hong | |
| 6,854,935 | B2 | 2/2005 | Andrews | |
| D519,651 | S | 4/2006 | Simic | |
| 7,086,205 | B2 | 8/2006 | Pervan | |
| D528,671 | S | 9/2006 | Grafenauer | |
| 7,607,271 | B2 | 10/2009 | Griffin et al. | |
| D633,219 | S | 2/2011 | Lai | |
| 7,896,571 | B1 | 3/2011 | Hannig et al. | |
| 8,038,363 | B2 | 10/2011 | Hannig et al. | |
| 8,215,083 | B2 | 7/2012 | Toas et al. | |
| D667,965 | S | 9/2012 | Tuan | |
| 8,268,431 | B2 | 9/2012 | Gao et al. | |
| 8,404,331 | B2 | 3/2013 | Kawakami et al. | |
| 8,409,380 | B2 | 4/2013 | Black et al. | |
| 8,726,602 | B2 | 5/2014 | Delong | |
| 8,793,959 | B2 | 8/2014 | Ruland | |
| 8,978,325 | B2 | 3/2015 | Lewis | |
| 9,068,372 | B2 | 6/2015 | Quinn et al. | |
| 9,127,459 | B2 | 9/2015 | Litral | |
| 9,181,699 | B2 | 11/2015 | Ciuperca | |
| D755,411 | S | 5/2016 | Hill et al. | |
| 9,382,703 | B2 | 7/2016 | Quinn et al. | |
| 9,394,697 | B2 | 7/2016 | Ramachandra | |
| D767,170 | S | 9/2016 | Labonte et al. | |
| 9,476,202 | B2 | 10/2016 | Clancy et al. | |
| 9,803,374 | B2 | 10/2017 | Pervan | |
| 9,995,045 | B2 | 6/2018 | Stevens, Jr. | |
| 10,196,808 | B1 | 2/2019 | Gibbs et al. | |
| 10,329,776 | B2 | 6/2019 | Meersseman et al. | |
| 10,422,131 | B2 | 9/2019 | Imbeau et al. | |
| 10,570,625 | B2 | 2/2020 | Pervan | |
| 2002/0189183 | A1 | 12/2002 | Ricciardelli | |
| 2004/0068954 | A1 | 4/2004 | Martensson | |
| 2004/0182032 | A1 | 9/2004 | Koschitzky | |
| 2006/0185299 | A1 | 8/2006 | Poupart | |
| 2006/0260252 | A1 | 11/2006 | Brice | |
| 2007/0193177 | A1 | 8/2007 | Wilson et al. | |
| 2008/0086965 | A1 | 4/2008 | Metz et al. | |
| 2008/0302030 | A1 | 12/2008 | Stancel et al. | |
| 2009/0126308 | A1 | 5/2009 | Hannig et al. | |
| 2010/0095630 | A1 | 4/2010 | Engstrom | |
| 2010/0281810 | A1 | 11/2010 | Ruland | |
| 2011/0030300 | A1 | 2/2011 | Liu | |
| 2013/0180198 | A1 | 7/2013 | Olson et al. | |
| 2013/0247502 | A1 | 9/2013 | Zhang | |
| 2013/0255174 | A1 | 10/2013 | Stafford et al. | |
| 2013/0266372 | A1 | 10/2013 | Bandura | |
| 2013/0343818 | A1 | 12/2013 | Bandura | |
| 2014/0000201 | A1 | 1/2014 | Lu et al. | |
| 2014/0033632 | A1 | 2/2014 | Chang | |
| 2014/0150355 | A1 | 6/2014 | Almeida Martins et al. | |
| 2014/0205377 | A1 | 7/2014 | Hill | |
| 2014/0260061 | A1 | 9/2014 | Knox | |
| 2015/0121799 | A1 | 5/2015 | Imbeau et al. | |
| 2016/0017612 | A1 | 1/2016 | Stafford et al. | |
| 2016/0032594 | A1 * | 2/2016 | Lovell | E04C 2/288 52/309.4 |
| 2017/0002561 | A1 | 1/2017 | Hettler et al. | |
| 2018/0044924 | A1 | 2/2018 | Flynn | |
| 2018/0355619 | A1 | 12/2018 | Neuman | |
| 2019/0153721 | A1 | 5/2019 | St. Germain | |
| 2020/0047469 | A1 | 2/2020 | Fang | |
| 2020/0354970 | A1 | 11/2020 | Hannig | |

FOREIGN PATENT DOCUMENTS

| | | | |
|---|---|---|---|
| CA | 2866109 | A1 | 9/2012 |
| CA | 2738146 | A1 | 10/2012 |
| WO | 2012107942 | A1 | 8/2012 |

OTHER PUBLICATIONS

Office Action from U.S. Appl. No. 17/215,049 dated Apr. 19, 2022.
3 Office Action from U.S. Appl. No. 17/215,049 dated Sep. 7, 2022.

* cited by examiner

INSULATION BOARDS WITH INTERLOCKING SHIPLAP EDGES

CROSS-REFERENCE TO RELATED APPLICATIONS

This application is a continuation of U.S. application Ser. No. 17/215,049, filed on Mar. 29, 2021, which claims priority to and any benefit of U.S. Provisional Application No. 63/020,463, filed May 5, 2020, the contents of which are incorporated herein by reference in their entireties.

FIELD

The general inventive concepts relate to foam insulation boards and, more particularly, to foam insulation boards with interlocking shiplap edges.

BACKGROUND

Rigid foam insulation boards (e.g., extruded polystyrene (XPS) boards) are well known. There are many applications for such boards. For example, it is known to use foam boards in the construction of insulated roadways, such as in permafrost regions. Given their dimensions (e.g., 4 feet×8 feet), many such boards are needed to form a roadway. In a conventional installation 100, as shown in FIGS. 1A and 1B, foam boards 102 having a defined thickness (e.g., 1.5 inches) are laid down next to each other to cover the width and length of the intended roadway. The edges of adjacent boards 102 can be fastened together (e.g., using tape, staples) to prevent displacement of the boards. However, because the edges where adjacent boards meet represent a potential "thermal break" (i.e., locations where the insulative properties of the system of boards 102 may be compromised), additional foam boards 102 having a defined thickness (e.g., 1.5 inches) are laid on top of the existing arrangement of foam boards 102, resulting in two distinct layers of the foam boards 102 having a combined total thickness (e.g., 3 inches). Of note, the upper layer of foam boards 102 are positioned in an offset manner relative to the lower layer of foam boards 102, such that the edges of adjacent foam boards 102 in the lower layer are covered by the foam boards 102 in the upper layer, and vice versa, as shown in FIG. 1B. Using two layers of foam board to resolve the "thermal break" issue represents a significant cost in terms of material, labor, and time to install.

Because the placement of two separate layers of foam boards is time (and, thus, cost) intensive, there is an unmet need for an improved foam insulation board that facilitates quicker, easier, and/or cheaper installation thereof.

SUMMARY

The general inventive concepts relate to a rigid insulation board having at least one interlocking shiplap edge. As used herein, the term "shiplap" is intended to encompass any shaping imparted to the edges of the insulation boards that allows the edges of adjacent boards to overlap with one another to form a substantially flush joint. The shaping can occur during formation of the boards of after formation thereof. To illustrate various aspects of the general inventive concepts, several exemplary embodiments of a rigid insulation board are disclosed.

In one exemplary embodiment, an insulation system comprises: a first insulation board having four edges, wherein a first shiplap is formed on at least one of the edges of the first insulation board; and a second insulation board having four edges, wherein a second shiplap is formed on at least one of the edges of the second insulation board; wherein the first shiplap has a width $a_1$; wherein the second shiplap has a width $a_2$; wherein the first shiplap has a thickness $b_1$; wherein the second shiplap has a thickness $b_2$; wherein the first insulation board has a thickness $e_1$; wherein the second insulation board has a thickness $e_2$; wherein the $a_1=a_2$; wherein $b_1=b_2$; wherein $b_1<e_1$; wherein $b_2<e_2$; wherein $e_1=e_2$; and wherein the first shiplap is operable to interface with the second shiplap to form an insulated joint between the first insulation board and the second insulation board.

In some exemplary embodiments, the first shiplap is formed on each of the four edges of the first insulation board; and the second shiplap is formed on each of the four edges of the second insulation board.

In some exemplary embodiments, the first shiplap is formed on two opposite edges of the first insulation board; and the second shiplap is formed on two opposite edges of the second insulation board.

In some exemplary embodiments, the first shiplap is formed on two adjacent edges of the first insulation board; and the second shiplap is formed on two adjacent edges of the second insulation board.

In some exemplary embodiments, the thickness $b_1$ of the first shiplap is uniform along the entire length of the at least one edge of the first insulation board; and the thickness $b_2$ of the second shiplap is uniform along the entire length of the at least one edge of the second insulation board.

In some exemplary embodiments, the thickness $b_1$ of the first shiplap is in the range of 25% to 75% of the thickness $e_1$; and the thickness $b_2$ of the second shiplap is in the range of 25% to 75% of the thickness $e_2$. In some exemplary embodiments, the thickness $b_1$ of the first shiplap is in the range of 45% to 55% of the thickness $e_1$; and the thickness $b_2$ of the second shiplap is in the range of 45% to 55% of the thickness $e_2$.

In some exemplary embodiments, the thickness $e_1$ of the first insulation board is in the range of 1 inch to 12 inches; and the thickness $e_2$ of the second insulation board is in the range of 1 inch to 12 inches. In some exemplary embodiments, the thickness $e_1$ of the first insulation board is in the range of 1 inches to 6 inches; and the thickness $e_2$ of the second insulation board is in the range of 1 inches to 6 inches.

In some exemplary embodiments, the insulation system further comprises fastening means for securing the first insulation board to the second insulation board at the insulated joint. In some exemplary embodiments, the fastening means is a tape. In some exemplary embodiments, the fastening means is an adhesive. In some exemplary embodiments, the fastening means is a staple.

In some exemplary embodiments, the first insulation board is made of a first foam; and the second insulation board is made of a second foam.

In some exemplary embodiments, the first foam is an extruded polystyrene foam. In some exemplary embodiments, the first foam is an expanded polystyrene foam. In some exemplary embodiments, the first foam is a polyisocyanurate foam. In some exemplary embodiments, the first foam is a polyethylene terephthalate (PET) foam. In some exemplary embodiments, the first foam is a phenolic foam.

In some exemplary embodiments, the second foam is an extruded polystyrene foam. In some exemplary embodiments, the second foam is an expanded polystyrene foam. In some exemplary embodiments, the second foam is a polyisocyanurate foam. In some exemplary embodiments, the second foam is a polyethylene terephthalate (PET) foam. In some exemplary embodiments, the second foam is a phenolic foam.

In some exemplary embodiments, the first foam and the second foam are different.

In one exemplary embodiment, an insulation system comprises: a first insulation board having four edges, wherein a first shiplap is formed on at least one of the edges of the first insulation board; and a second insulation board having four edges, wherein a second shiplap is formed on at least one of the edges of the second insulation board; wherein the first shiplap includes a first leg portion and a first end portion; wherein the second shiplap includes a second leg portion and a second end portion; wherein the first leg portion has a width $c_1$; wherein the second leg portion has a width $c_2$; wherein the first end portion has a width $d_1$; wherein the second end portion has a width $d_2$; wherein the first insulation board has a thickness $e_1$; wherein the second insulation board has a thickness $e_2$; wherein the first leg portion has a thickness $g_1$; wherein the second leg portion has a thickness $g_2$; wherein the first end portion has a thickness $i_1$; wherein the second end portion has a thickness $i_2$; wherein a space between an upper surface of the first leg portion and an upper surface of the first insulation board has a thickness $f_1$; wherein a space between an upper surface of the second leg portion and an upper surface of the second insulation board has a thickness $f_2$; wherein a space between an upper surface of the first end portion and an upper surface of the first insulation board has a thickness $h_1$; wherein a space between an upper surface of the second end portion and an upper surface of the second insulation board has a thickness $h_2$; wherein $g_1<i_1<e_1$; wherein $g_2<i_2<e_2$; wherein $e_1-g_1=f_1$; wherein $e_2-g_2=f_2$; wherein $e_1-i_1=h_1$; wherein $e_2-i_2=h_2$; and wherein the first shiplap is operable to interface with the second shiplap to form an insulated joint between the first insulation board and the second insulation board.

In some exemplary embodiments, $c_1=d_1$; and $c_2=d_2$.

In some exemplary embodiments, $c_1<d_1$; and $c_2<d_2$.

In some exemplary embodiments, $c_1>d_1$; and $c_2>d_2$.

In some exemplary embodiments, $f_1=i_1$; and $f_2=i_2$.

In some exemplary embodiments, $f_1>i_1$; and $f_2>i_2$.

In some exemplary embodiments, the first shiplap is formed on each of the four edges of the first insulation board; and the second shiplap is formed on each of the four edges of the second insulation board.

In some exemplary embodiments, the first shiplap is formed on two opposite edges of the first insulation board; and the second shiplap is formed on two opposite edges of the second insulation board.

In some exemplary embodiments, the first shiplap is formed on two adjacent edges of the first insulation board; and the second shiplap is formed on two adjacent edges of the second insulation board.

In some exemplary embodiments, the thickness $e_1$ of the first insulation board is in the range of 1 inch to 12 inches; and the thickness $e_2$ of the second insulation board is in the range of 1 inch to 12 inches. In some exemplary embodiments, the thickness $e_1$ of the first insulation board is in the range of 1 inches to 6 inches; and the thickness $e_2$ of the second insulation board is in the range of 1 inches to 6 inches.

In some exemplary embodiments, the first insulation board is made of a first foam; and the second insulation board is made of a second foam.

In some exemplary embodiments, the first foam is an extruded polystyrene foam. In some exemplary embodiments, the first foam is an expanded polystyrene foam. In some exemplary embodiments, the first foam is a polyisocyanurate foam. In some exemplary embodiments, the first foam is a polyethylene terephthalate (PET) foam. In some exemplary embodiments, the first foam is a phenolic foam.

In some exemplary embodiments, the second foam is an extruded polystyrene foam. In some exemplary embodiments, the second foam is an expanded polystyrene foam. In some exemplary embodiments, the second foam is a polyisocyanurate foam. In some exemplary embodiments, the second foam is a polyethylene terephthalate (PET) foam. In some exemplary embodiments, the second foam is a phenolic foam.

In some exemplary embodiments, the first foam and the second foam are different.

In some exemplary embodiments, $c_1=d_1$; $c_2=d_2$; $f_1=i_1$; and $f_2=i_2$.

In some exemplary embodiments, $c_1=d_1$; $c_2=d_2$; $f_1>i_1$; and $f_2>i_2$.

In some exemplary embodiments, $c_1<d_1$; $c_2<d_2$; $f_1=i_1$; and $f_2=i_2$.

In some exemplary embodiments, $c_1<d_1$; $c_2<d_2$; $f_1>i_1$; and $f_2>i_2$.

In some exemplary embodiments, $c_1>d_1$; $c_2>d_2$; $f_1=i_1$; and $f_2=i_2$.

In some exemplary embodiments, $c_1>d_1$; $c_2>d_2$; $f_1>i_1$; and $f_2>i_2$.

In one exemplary embodiment, an insulation board has four edges, wherein a shiplap is formed on at least one of the edges of the insulation board; wherein the shiplap includes a leg portion and an end portion; wherein the leg portion has a width c; wherein the end portion has a width d; wherein the insulation board has a thickness e; wherein the leg portion has a thickness g; wherein the end portion has a thickness i; wherein a space between an upper surface of the leg portion and an upper surface of the insulation board has a thickness f; wherein a space between an upper surface of the end portion and an upper surface of the insulation board has a thickness h; wherein $g<i<e$; wherein $e-g=f$; wherein $e-i=h$; and wherein the first shiplap is operable to interface with the second shiplap to form an insulated joint between the first insulation board and the second insulation board.

Other aspects and features of the general inventive concepts will become more readily apparent to those of ordinary skill in the art upon review of the following description of various exemplary embodiments in conjunction with the accompanying figures.

BRIEF DESCRIPTION OF THE DRAWINGS

The general inventive concepts, as well as embodiments and advantages thereof, are described below in greater detail, by way of example, with reference to the drawings in which:

FIG. 1A is a side elevational view of the boards. FIG. 1B is a top plan view of the boards.

FIG. 2A is a side elevational view of the boards. FIG. 2B is a side elevational view of the boards interfaced with one another. FIG. 2C is a top plan view of the boards interfaced with one another.

FIG. 3A is a side elevational view of one edge of a portion of the foam insulation board. FIG. 3B is a side elevational view of the edge of the portion of the foam insulation board. FIG. 3C is a side elevational view of the edge of the portion of the foam insulation board.

DETAILED DESCRIPTION

Several illustrative embodiments will be described in detail with the understanding that the present disclosure merely exemplifies the general inventive concepts. Embodiments encompassing the general inventive concepts may take various forms and the general inventive concepts are not intended to be limited to the specific embodiments described herein.

The general inventive concepts are based, at least in part, on the discovery that forming an insulation board with an interlocking shiplap on at least one edge of the board facilitates quicker, easier, and/or cheaper installation thereof.

The general inventive concepts relate to a rigid insulation board having at least one interlocking shiplap edge.

Figure 1A:
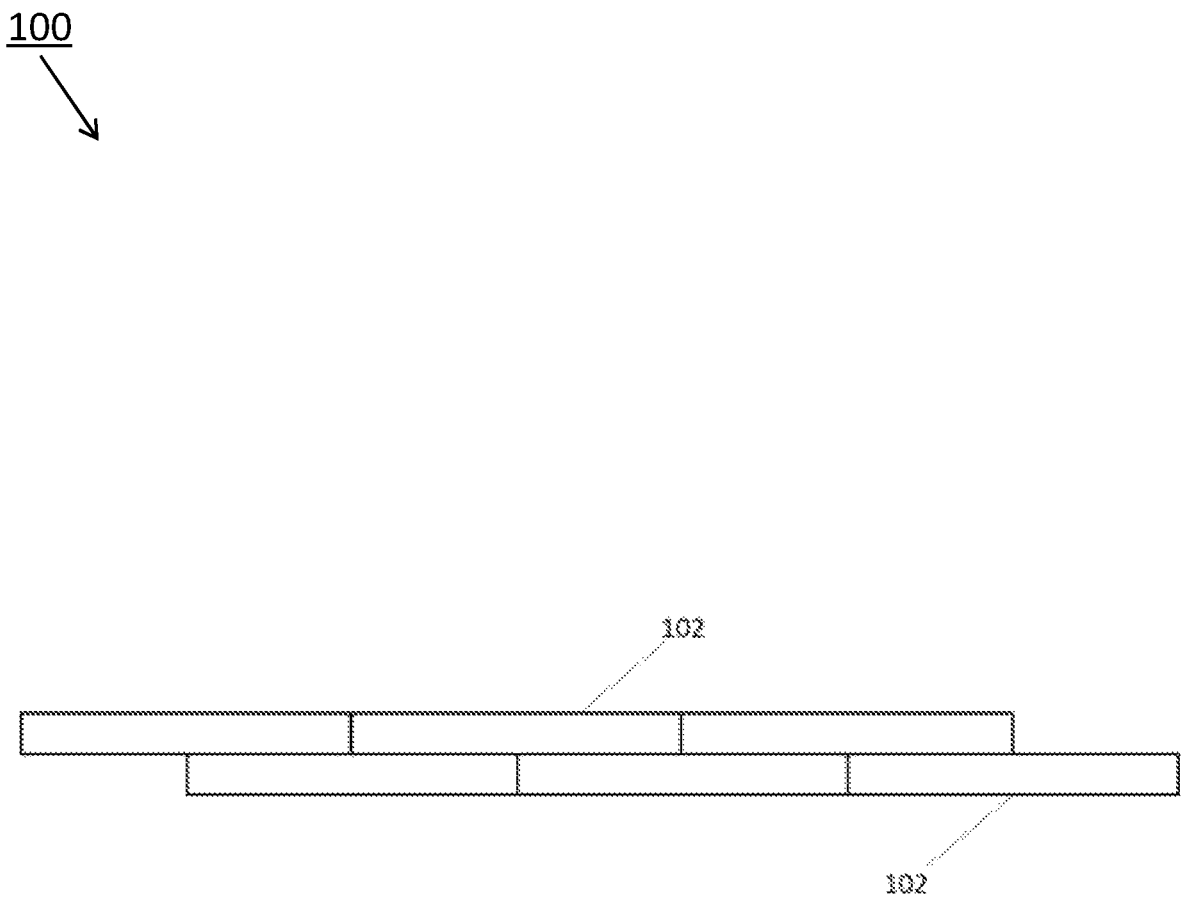
FIG. 1A PRIOR ART
FIGS. 1A and 1B illustrate conventional foam insulation boards being interfaced with one another.
Figure 1B:
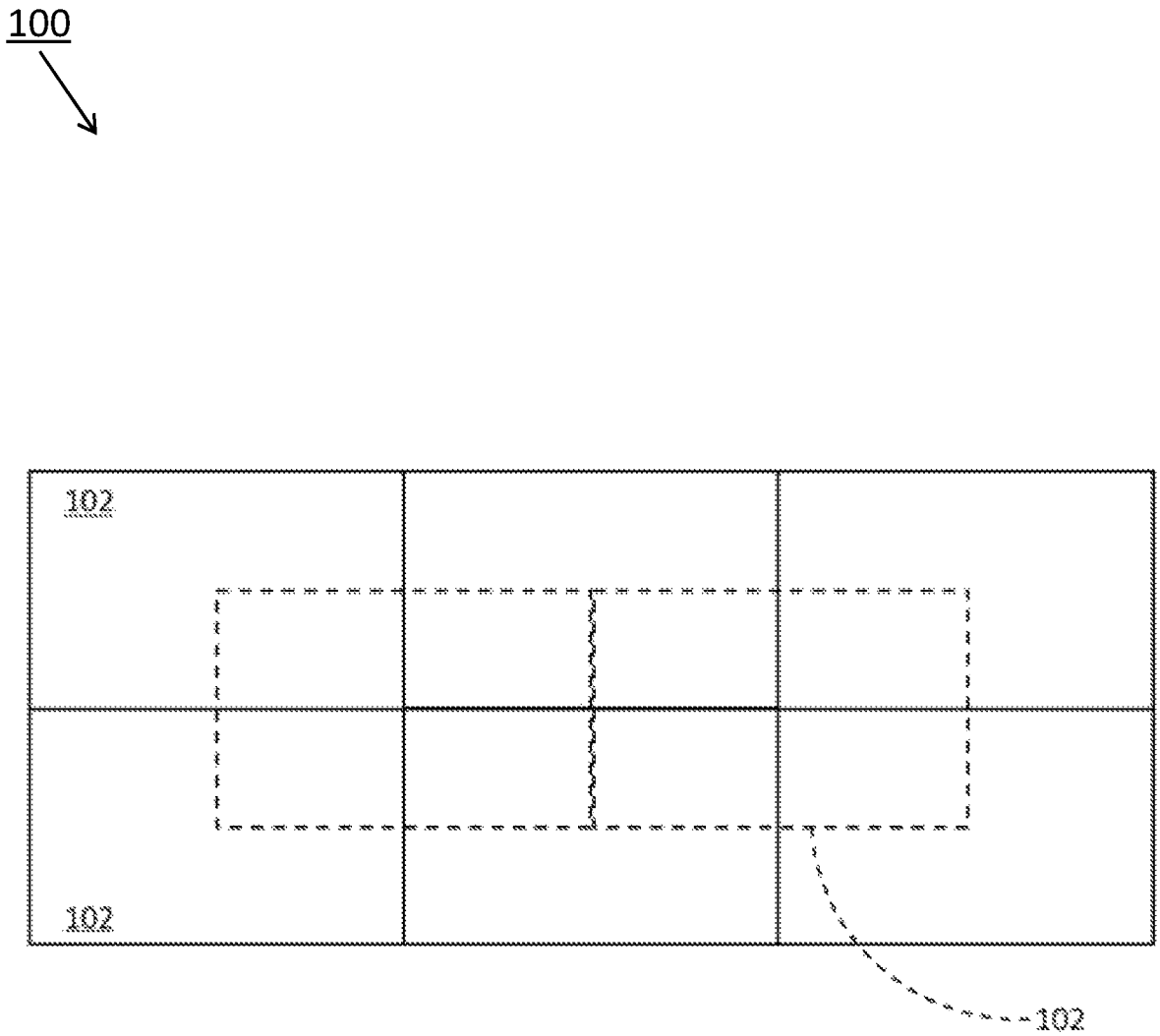
FIG. 1B PRIOR ART
Figure 2A:
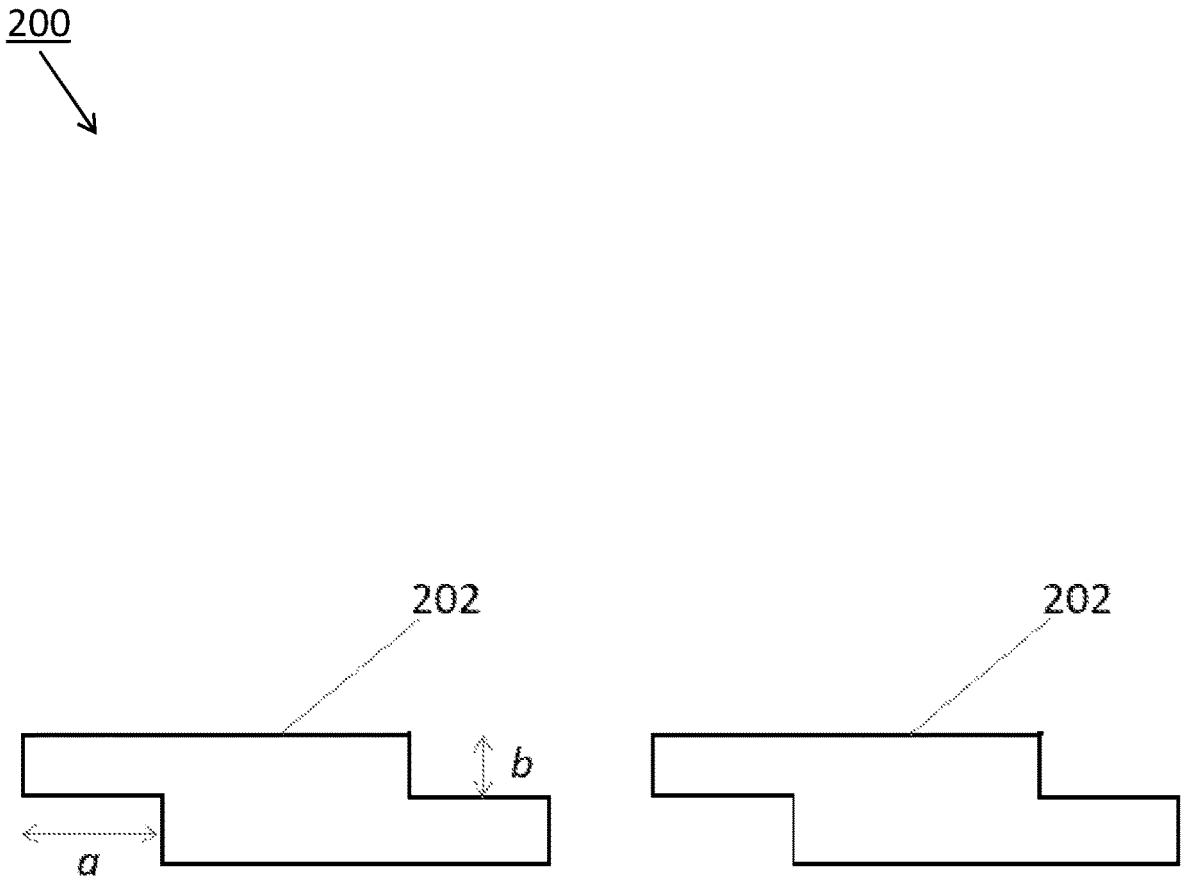
FIGS. 2A, 2B, and 2C illustrate foam insulation boards with shiplap edges, according to one exemplary embodiment.
Figure 2B:
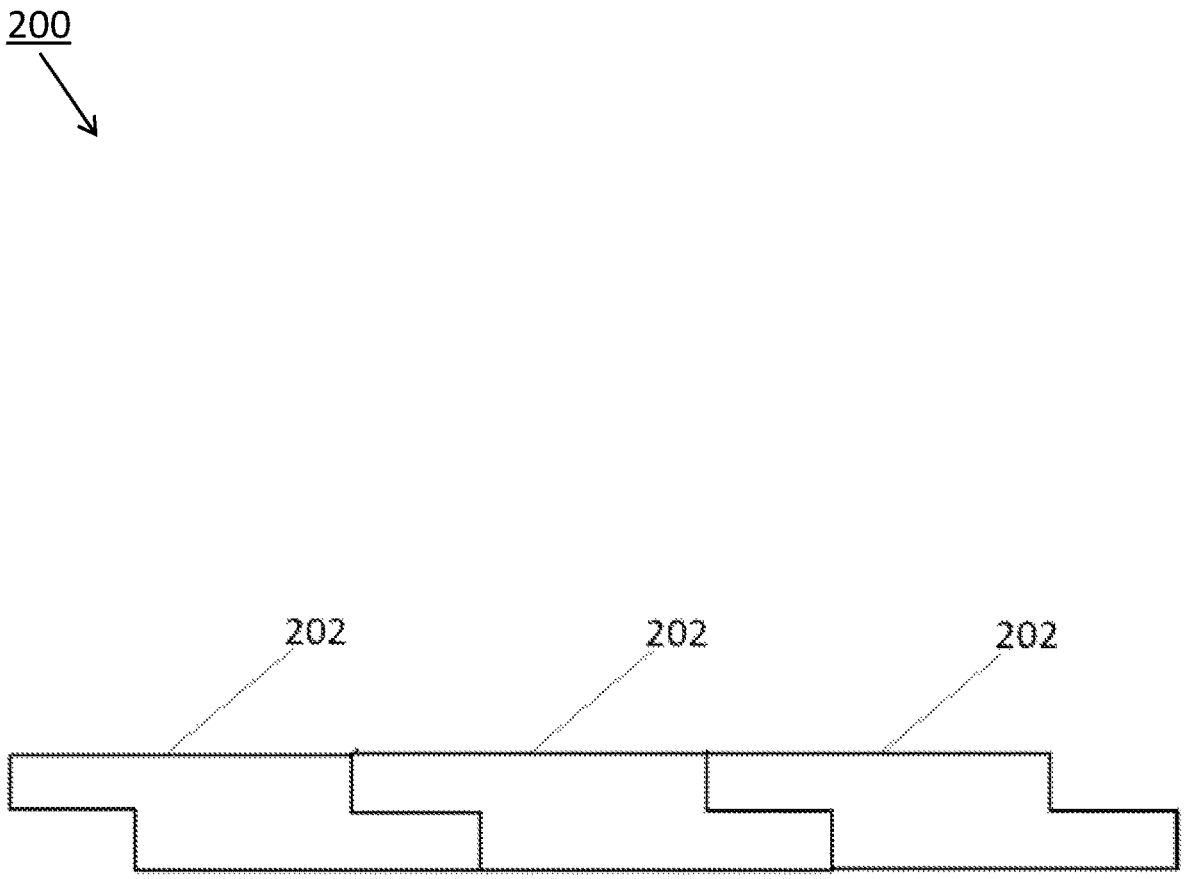

As noted above, because the placement of two separate layers of foam boards is time (and, thus, cost) intensive, it is proposed (in one exemplary embodiment of an installation 200) to use a modified foam board 202 having a defined thickness (e.g., 3 inches). The board 202 allows for a single layer of the boards to be used to effectively insulate a roadway. The foam board 202 has a shiplap edge formed around all four sides thereof, as shown in FIGS. 2A and 2B. In some exemplary embodiments, a length of the shiplap edge is the same as a length of the side. In some exemplary embodiments, a length of the shiplap edge is less than a length of the side. The shiplap edge has a width a (e.g., 3 inches) and a depth b (e.g., 1.5 inches). Typically, any width a can be used for the shiplap edge, so long as the width a is suitable to resist movement of the boards 202 relative to one another and to prevent formation of a thermal break at the interface of adjacent boards. Typically, the depth b will be ½ of the total board thickness. In some exemplary embodiments, the depth b is in the range of 25% of the total board thickness to 75% of the total board thickness.

Figure 2C:
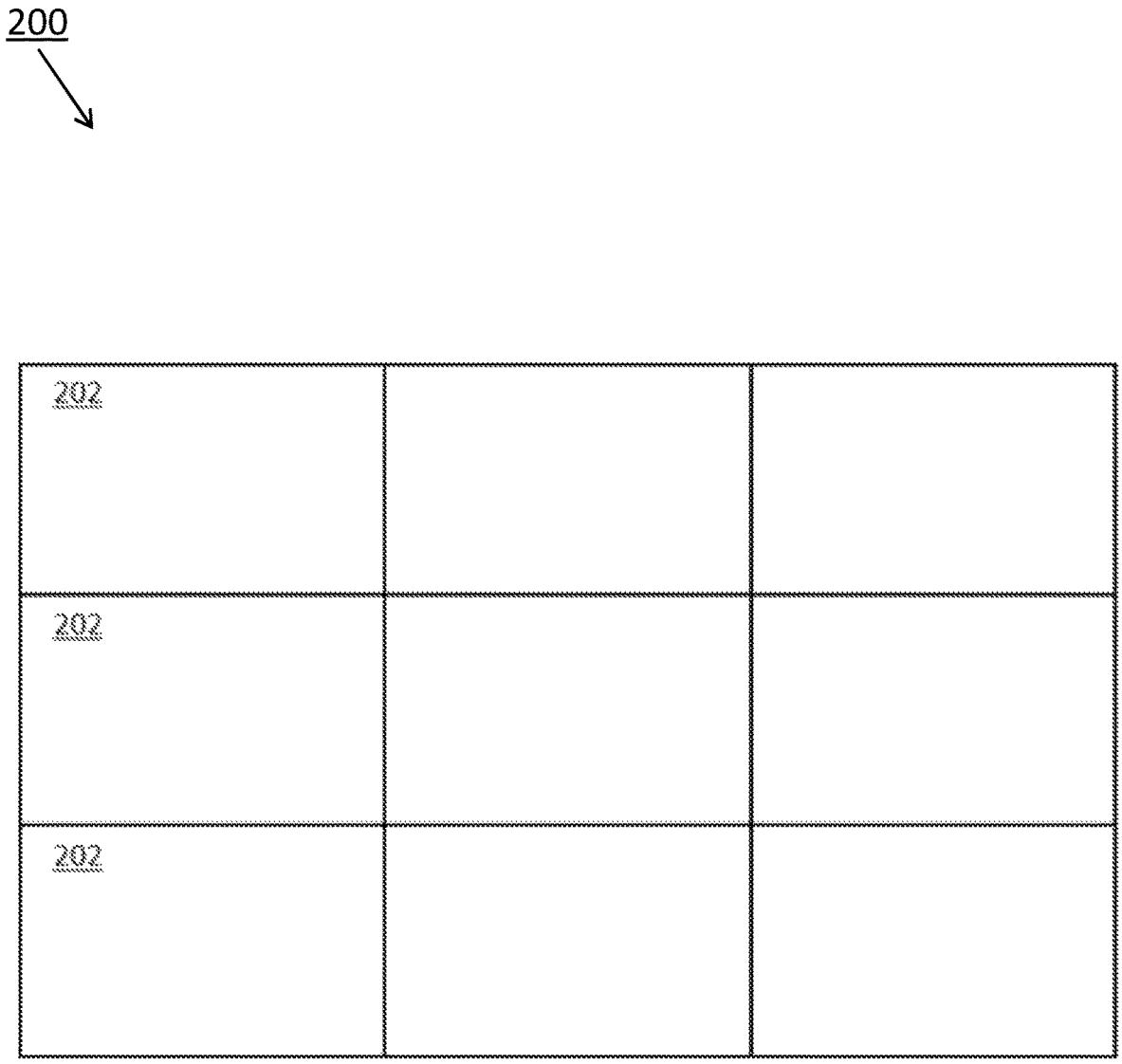

The foam boards 202 are laid down next to each other to cover the width and length of the intended roadway. More specifically, the foam boards 202 are arranged so that the shiplap edges of adjacent boards 202 interface with one another in a complementary manner, as shown in FIG. 2B. Because the mated shiplap edges avoid any thermal break at the interface between adjacent boards, only a single layer of the foam boards 202 need be placed for the roadway, as shown in FIG. 2C, which results in a significant installation time savings. Furthermore, the mated shiplap edges are more likely to prevent movement of the boards 202, such that there is less of a need for fasteners, which also results in a significant installation time savings.

Figure 3A:
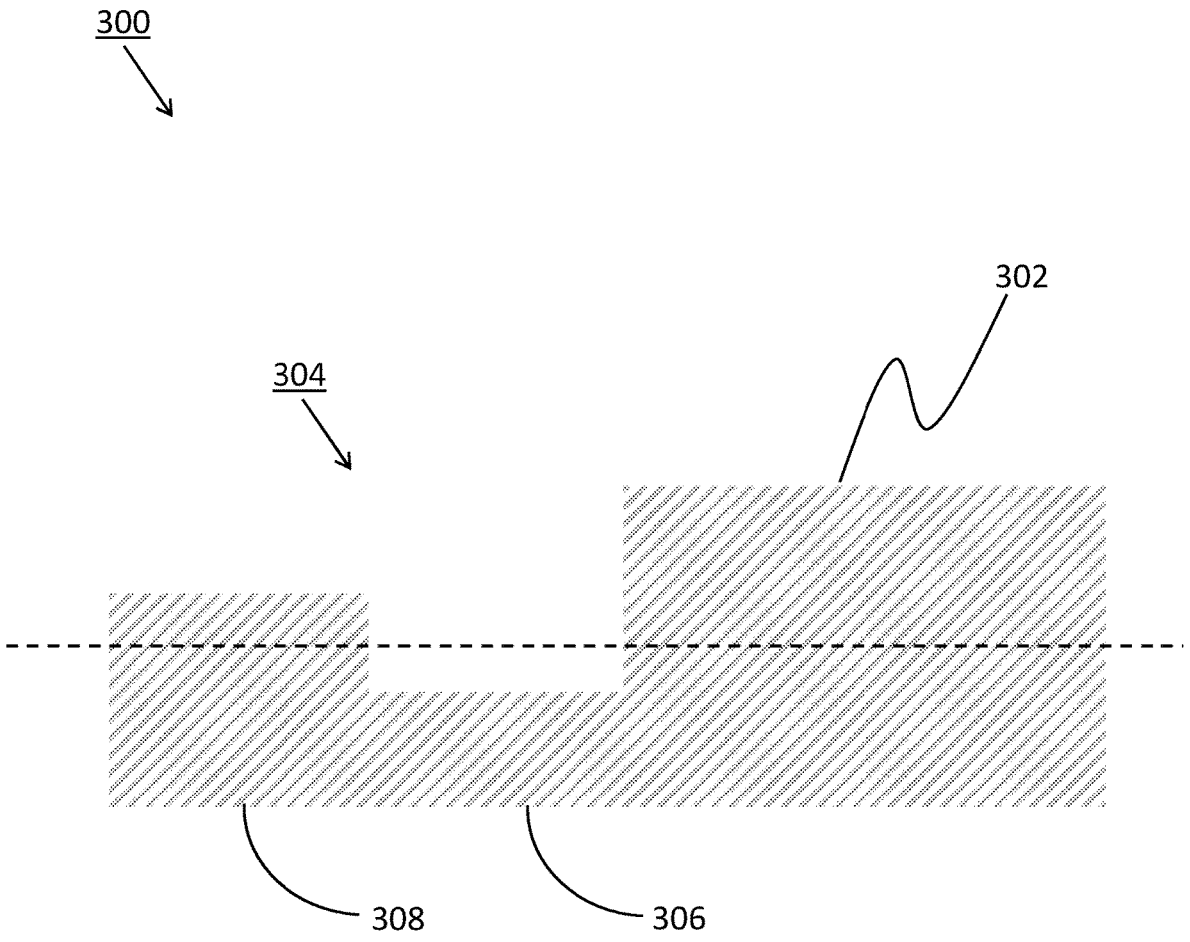
FIGS. 3A, 3B, and 3C illustrate foam insulation boards with shiplap edges, according to another exemplary embodiment.
Figure 3B:
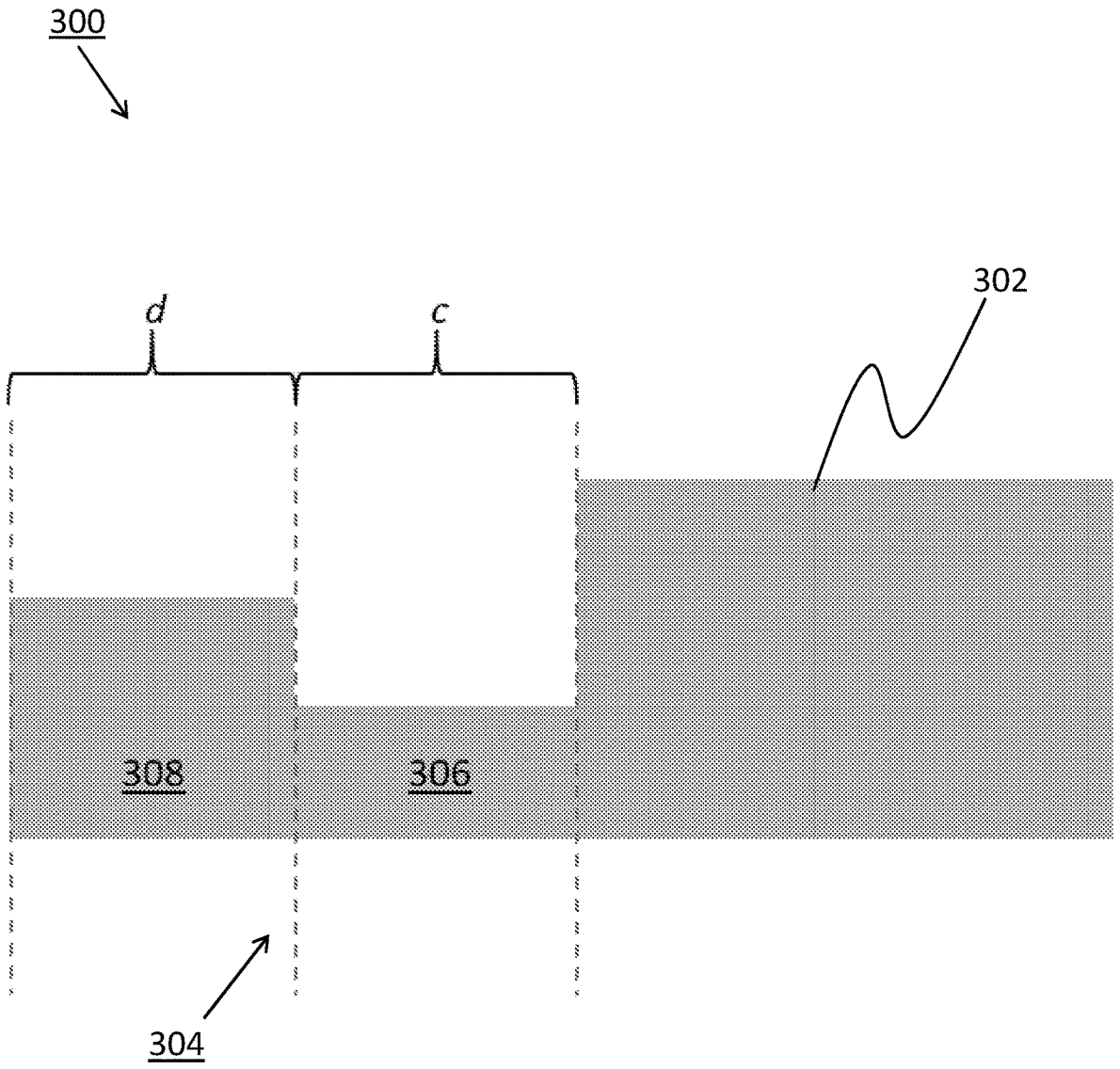
Figure 3C:
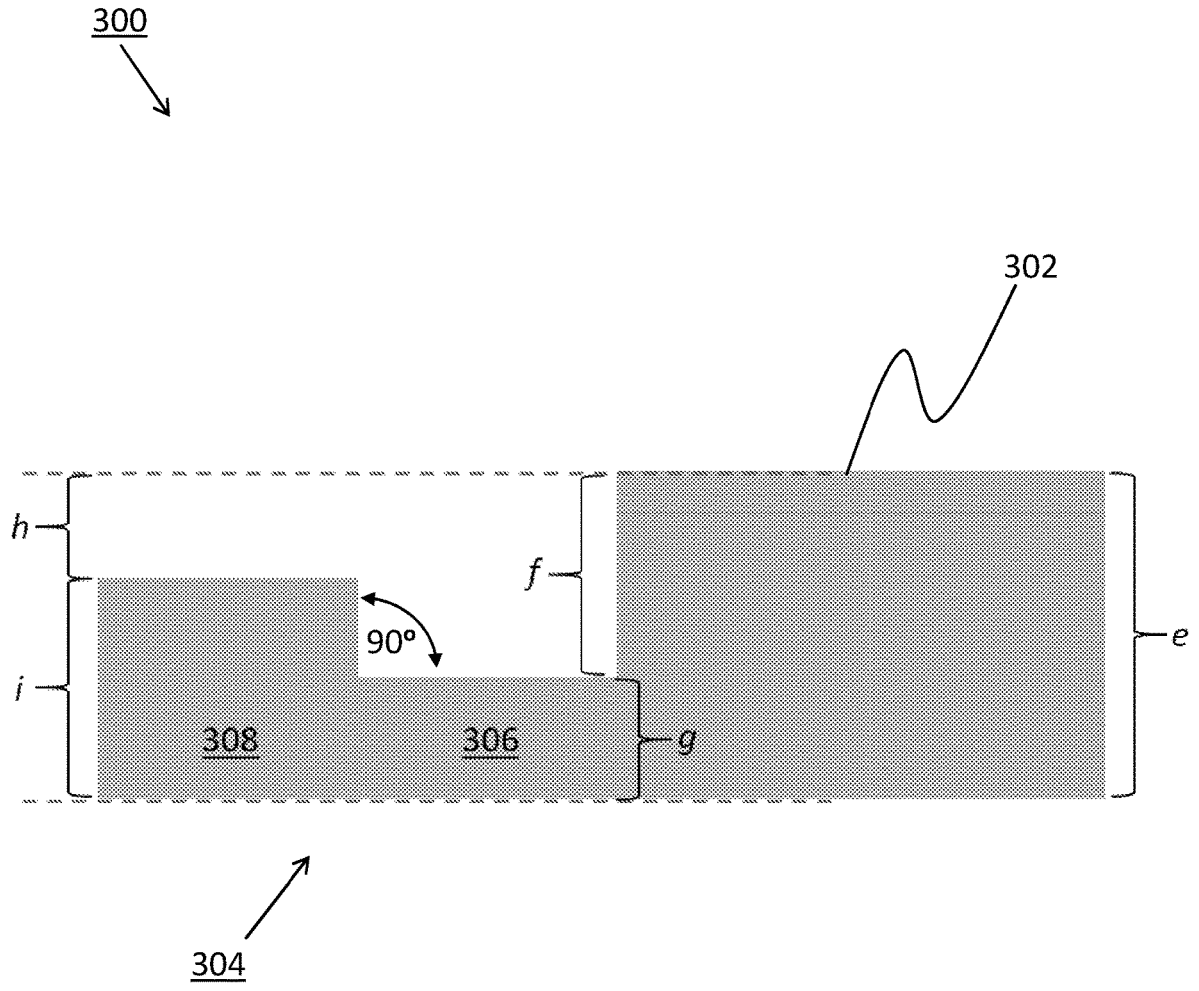

Nonetheless, movement of the boards 202 may still occur. Thus, in another exemplary embodiment of an installation 300, it is proposed to use a modified foam board 302 having a defined thickness (e.g., 3 inches). The board 302 allows for a single layer of the boards to be used to effectively insulate a roadway. However, as shown in FIGS. 3A-3C, the board 302 had a modified shiplap 304 formed on at least one edge thereof. In some exemplary embodiments, the modified shiplap 304 extends along the entire edge. In some exemplary embodiments, the modified shiplap 304 extends along a portion of the edge.

In some exemplary embodiments, the modified shiplap 304 is formed on all sides of the foam board 302. In some exemplary embodiments, the modified shiplap 304 is formed on two sides of the foam board 302, wherein the two sides are opposite one another. In some exemplary embodiments, the modified shiplap 304 is formed on two sides of the foam board 302, wherein the two sides are adjacent to one another.

More specifically, the shiplap 304 is formed, such as by removing material from the board 302, with specific dimensions that form a leg portion 306 and an end portion 308. The general inventive concepts are not limited to a particular approach to forming the shiplap 304. For example, while the shiplap 304 could be formed mechanically (e.g., by milling, computer numerical control (CNC) routing with abrasive or hot wire, sawing, etc.), the shiplap 304 could also be pre-formed in the edge during manufacture of the foam board 302.

Each of the leg portion 306 and the end portion 308 has a thickness that is less than a thickness of the board 302. Furthermore, in general, the thickness of the leg portion 306 is less than the thickness of the end portion 308.

As shown in FIG. 3B, a width of the leg portion 306 of the shiplap 304 is denoted by the letter c, while a width of the end portion 308 of the shiplap 304 is denoted by the letter d.

As shown in FIG. 3C, the thickness of the board 302 is denoted by the letter e, the thickness of the leg portion 306 is denoted by the letter g (which is equal to e-f), and the thickness of the end portion 308 is denoted by the letter i (which is equal to e-h).

In some exemplary embodiments, the thickness e is in the range of 1 inch to 12 inches. In some exemplary embodiments, the thickness e is in the range of 1 inches to 6 inches.

Figure 4:
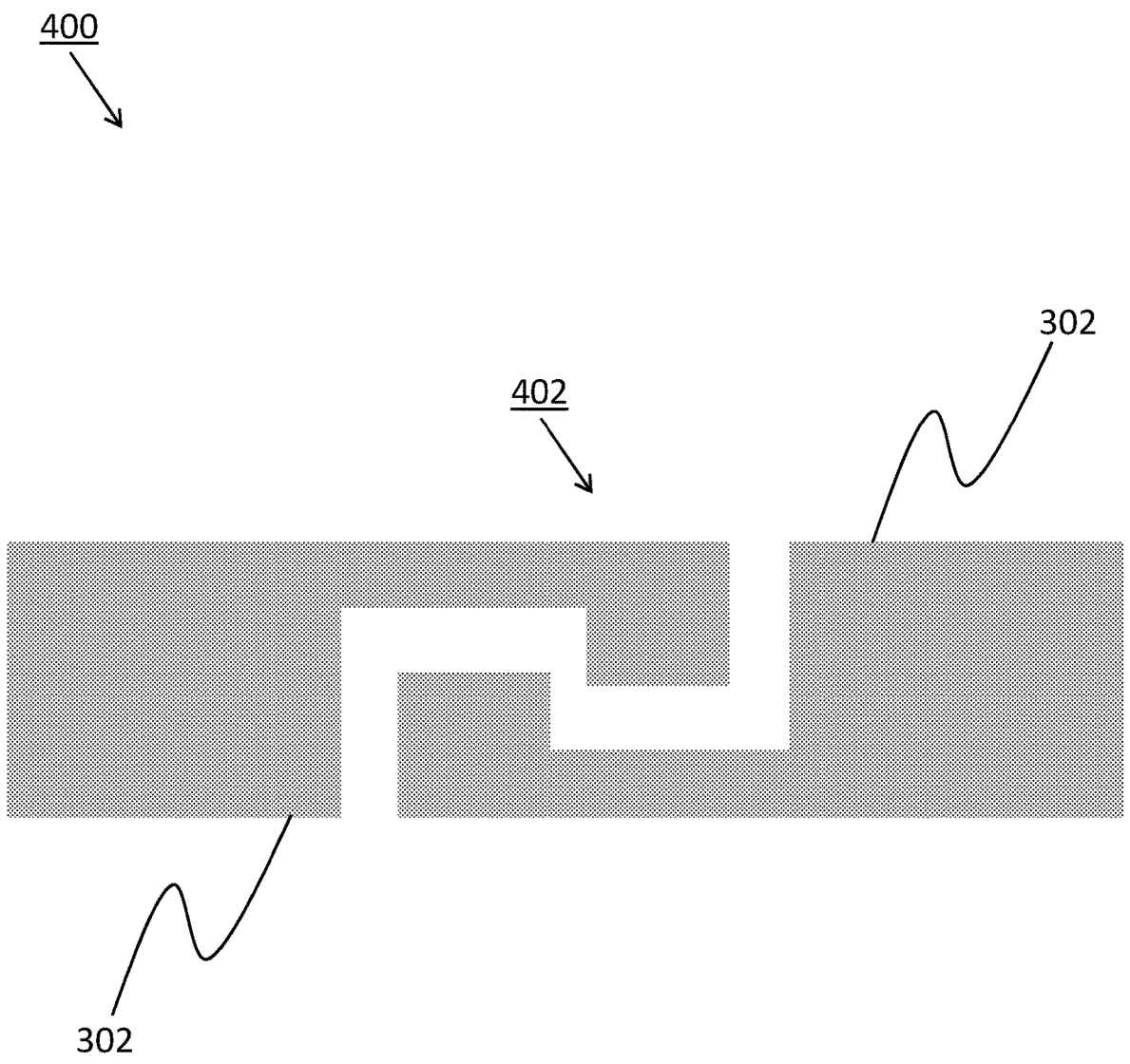
FIG. 4 is a side elevational view showing the foam insulation boards of FIG. 3A interfaced with one another.

The shiplap 304 is sized and shaped so that it can interface with similar shiplaps on other boards, as shown in the installation 400 of FIG. 4. In particular, the shiplap 304 allows adjacent boards 302 to effectively be "locked" together at a joint 402. In other words, once positioned together, the boards 302 with the shiplaps 304 are less likely to move relative to one another than boards without shiplaps or boards with conventional shiplaps. In this manner, the installation 400 can generally be performed more quickly and reliably. By interlocking the adjacent foam boards 302, the field or array of boards react as one homogeneous layer instead of individually, which increases the resistance of the installation 400 to wind uplift and displacement. Furthermore, the interfaced shiplaps 304 avoid or otherwise mitigate against a thermal break at the joint 402. In some instances, the interfaced shiplaps 304 may be sufficient to lock the boards together without requiring any additional fasteners (e.g., tape, staples).

According to the general inventive concepts, the actual dimensions of the shiplap 304 can be selected or otherwise adjusted based on the thickness e of the board 302, the desired properties (e.g., strength) of the edge with the shiplap 304, the behavior of the interface between interlocked boards 302, etc.

For example, in one exemplary embodiment, the shiplap 304 is designed to provide a loose fitting joint between interlocked boards 302. It is contemplated that during installation of the boards 302 in road sections, the alignment of the boards 302 will not always be uniform. Consequently, fabricating the shiplap 304 so that the interlocking joint formed between adjacent boards 302 has matching dimensions (e.g., c=d or f=i may prove problematic during installation. This is particularly true if the boards are not perfectly square or cut to the same length. Thus, in this embodiment, the shiplap 304 is formed such that c>d and/or f>i, which results in a joint 402 that provides space to allow the adjacent boards to better accommodate any misalignment.

In another exemplary embodiment, the shiplap 304 is designed to provide a tight fitting joint between interlocked boards 302. It is contemplated that having a tight fitting joint will better prevent the boards 302 from moving relative to one another after installation. This embodiment is particularly suited to foam boards that have a degree of compressibility, such as with XPS foam boards. In this case, the shiplap 304 is formed such that d>c. By slightly oversizing dimension d, relative to dimension c, it forces compression of dimension d to fit into dimension c. This compression creates a friction fit that "locks" the adjacent boards together and keeps them from inadvertently separating.

In accordance with the general inventive concepts, the particular dimensions of the shiplap structure can be structured to provide flexibility of the interlocking joint to suit a particular application. In some exemplary embodiments, c=d. In some exemplary embodiments, c>d. In some exemplary embodiments, c<d. In some exemplary embodiments, f=i. In some exemplary embodiments, f>i. In some exemplary embodiments, h=g. In some exemplary embodiments, h>g. In some exemplary embodiments, (i−g)=h. The general inventive concepts encompass the various permutations/combinations of these dimensional relationships (e.g., c:d, f:i, etc.), for example, c>d and f>i.

Figure 5:
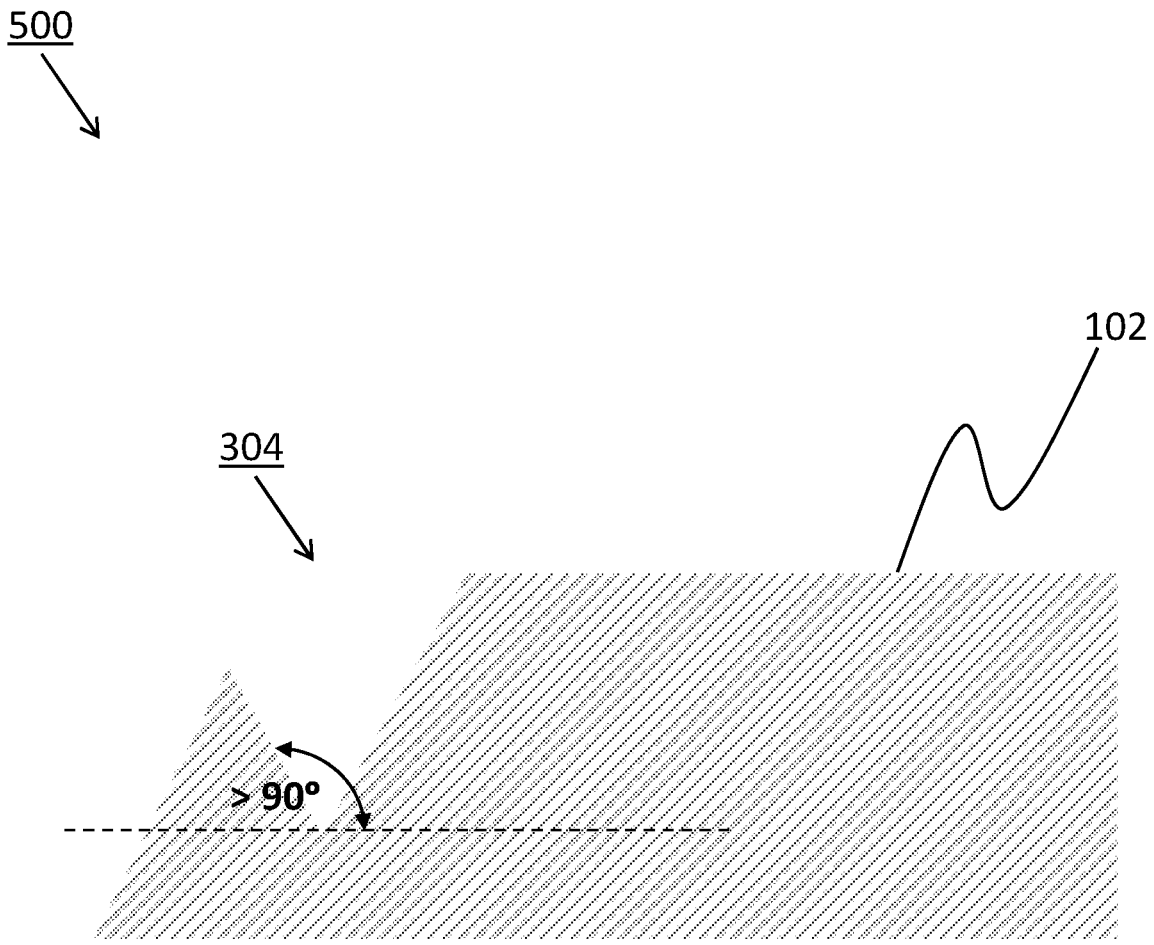
FIG. 5 illustrates a side elevational view of a shiplap edge of a foam insulation board, according to another exemplary embodiment.
Figure 6:
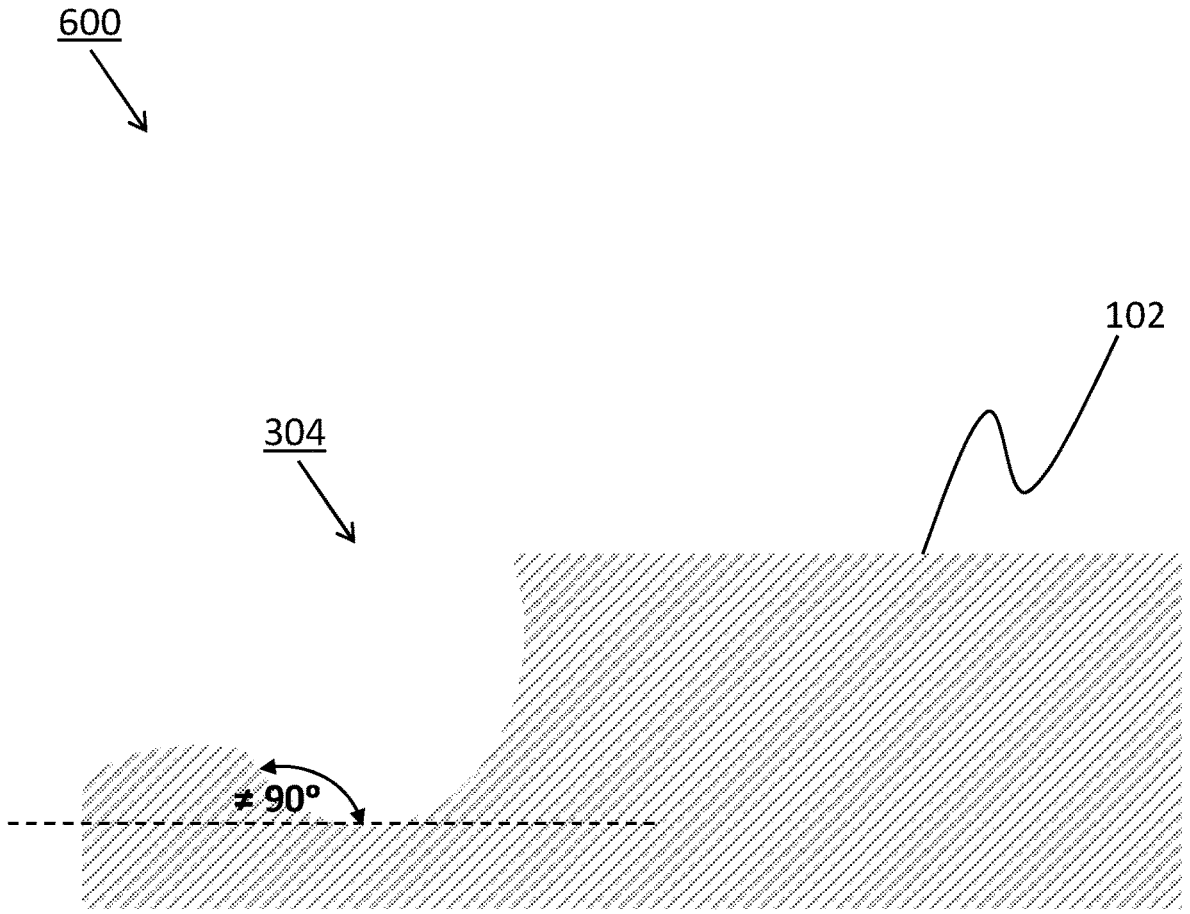
FIG. 6 illustrates a side elevational view of a shiplap edge of a foam insulation board, according to another exemplary embodiment.
Figure 7:
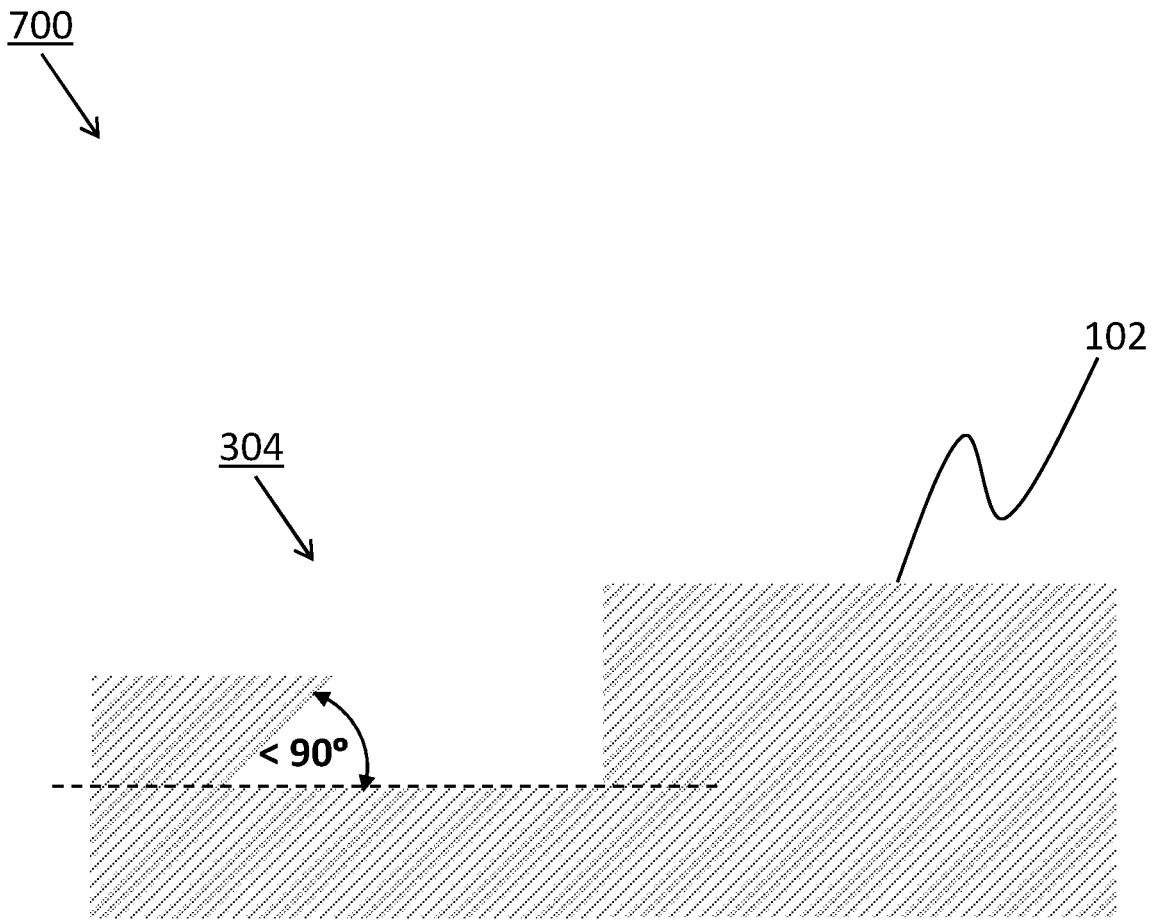
FIG. 7 illustrates a side elevational view of a shiplap edge of a foam insulation board, according to another exemplary embodiment.

While the shiplap 304 edges (and resulting joint 402) described above involve flat faces (e.g., leg portions and end portions) that meet at 90-degree angles, the general inventive concepts contemplate embodiments wherein the shiplap 304 assumes a different geometry, such as a shiplap 500 with a V-shape (see FIG. 5), a shiplap 600 with a curved/arched-shape (see FIG. 6), a shiplap 700 with an angled shape (see FIG. 7), or a shiplap with any other shape that enhances the strength of the joint 402.

While various exemplary embodiments are described herein in the context of foam boards, any suitably rigid insulating member (e.g., board, panel) may be used. In the case of foam boards, any suitable foaming mechanism (e.g., an extruded polystyrene (XPS) foam, an expanded polystyrene (EPS) foam, a polyisocyanurate foam, a polyethylene terephthalate (PET) foam, a phenolic foam, etc.) may be used.

Furthermore, while various exemplary embodiments are described herein in the context of insulating a roadway, it should be understood that the general inventive concepts contemplate many other potential applications in which the interlocking shiplap edge could provide meaningful advantages, such as commercial roofing, below slab insulation, radon barrier systems, precast or site cast concrete sandwich panels, etc.

In general, in some embodiments, it may be possible to utilize the various inventive concepts in combination with one another. Additionally, any particular element recited as relating to a particularly disclosed embodiment should be interpreted as available for use with all disclosed embodiments, unless incorporation of the particular element would be contradictory to the express terms of the embodiment. The scope of the general inventive concepts presented herein are not intended to be limited to the particular exemplary embodiments shown and described herein. From the disclosure given, those skilled in the art will not only understand the general inventive concepts and their attendant advantages, but will also find apparent various changes and modifications thereto. For example, as noted above, the inventive foam boards disclosed and suggested herein can be used at least in any application for which foam boards are known to be suitable. It is sought, therefore, to cover all such changes and modifications as fall within the spirit and scope of the general inventive concepts, as described and/or claimed herein, and any equivalents thereof.

It is claimed:

1. A method of insulating a roadway, the method comprising:

forming a first board that consists of a first insulation material;

forming a second board that consists of a second insulation material;

removing a portion of the first insulation material from the first board to form a first shiplap along at least one edge of the first board;

removing a portion of the second insulation material from the second board to form a second shiplap along at least one edge of the second board;

placing the first board on a surface defining the roadway;

placing the second board on the surface defining the roadway; and interfacing the first shiplap of the first board and the second shiplap of the second board to form an insulated joint, the insulated joint consisting of the first insulation material and the second insulation material, wherein the first insulation material and the second insulation material are different.

2. The method of claim 1, wherein the step of removing the portion of the first insulation material from the first board to form the first shiplap occurs in proximity to the roadway.

3. The method of claim 1, wherein the step of removing the portion of the second insulation material from the second board to form the second shiplap occurs in proximity to the roadway.

4. The method of claim 1, wherein the first insulation material is an extruded polystyrene foam.

5. The method of claim 1, wherein the second insulation material is an extruded polystyrene foam.

6. The method of claim 1, wherein the first board has a thickness in the range of 1 inch to 6 inches.

7. The method of claim 6, wherein the first board has a thickness of about 3 inches.

8. The method of claim 1, wherein the second board has a thickness in the range of 1 inch to 6 inches.

9. The method of claim 8, wherein the second board has a thickness of about 3 inches.

10. The method of claim 1, wherein the first board has a width of at least 4 feet and a length of at least 8 feet.

11. The method of claim 1, wherein the second board has a width of at least 4 feet and a length of at least 8 feet.

12. The method of claim 1, wherein the first insulation material is a first foam material, and wherein the second insulation material is a second foam material.

13. The method of claim 12, wherein the first foam material is an extruded polystyrene foam, and wherein the second foam material is an expanded polystyrene foam.

14. The method of claim 1, wherein at least one of the first shiplap and the second shiplap has a V-shape.

15. The method of claim 1, wherein at least one of the first shiplap and the second shiplap has a curved shape.

16. The method of claim 1, wherein at least one of the first shiplap and the second shiplap has an angled portion, wherein the angled portion forms an angle of less than 90 degrees.

* * * * *